United States Patent [19]

Flores Bermudez

[11] Patent Number: 4,791,985

[45] Date of Patent: Dec. 20, 1988

[54] SYSTEM TO PROPORTION ASSISTING FLUIDS IN A WELL

[75] Inventor: Simon C. Flores Bermudez, Edo. Monagas, Venezuela

[73] Assignee: Lagoven, S.A., Caracas, Venezuela

[21] Appl. No.: 95,569

[22] Filed: Sep. 11, 1987

[51] Int. Cl.[4] ..... E21B 43/00

[52] U.S. Cl. ..... 166/68; 166/106; 166/310; 166/902

[58] Field of Search ..... 166/369–372, 166/305.1, 310, 68, 68.5, 105–110, 902; 417/313

[56] References Cited

U.S. PATENT DOCUMENTS

| | | | |
|---|---|---|---|
| 1,437,939 | 12/1922 | Green | 166/105 |
| 2,530,673 | 11/1950 | Zinszer | 166/105 |
| 2,654,436 | 10/1953 | Carlisle et al. | 166/310 |
| 3,196,947 | 7/1965 | Van Poolen | 166/369 X |
| 3,418,938 | 12/1968 | Vincent | 417/313 |
| 3,548,946 | 12/1970 | Engle | 166/310 |
| 3,712,862 | 1/1973 | Bundrant et al. | 166/310 X |
| 3,802,802 | 4/1974 | Greer | 417/313 X |
| 4,042,033 | 8/1977 | Holland et al. | 166/310 |
| 4,573,529 | 3/1986 | Reinhardt | 166/68 |
| 4,615,389 | 10/1986 | Neely et al. | 166/310 X |

FOREIGN PATENT DOCUMENTS

| | | | |
|---|---|---|---|
| 684131 | 9/1979 | U.S.S.R. | 166/310 |

*Primary Examiner*—Hoang C. Dang
*Attorney, Agent, or Firm*—Bachman & LaPointe

[57] ABSTRACT

The present invention relates to an improved system and method for recovering oil. The system includes a subsoil pump for pumping oil to the surface having an opening in its casing through which an assisting, treatment, or maintenance fluid may be added in a desired quantity. The opening is located substantially at the level of the pump's oil inlet and communicates with a supply of fluid via a passageway having a check valve for admitting only precise quantities of fluid to the opening.

4 Claims, 2 Drawing Sheets

SYSTEM TO PROPORTION ASSISTING FLUIDS IN A WELL

BACKGROUND OF THE INVENTION

The present invention relates to the recovery of crude oil from a formation and more particularly, to a method and system for injecting into a well any fluid which may be useful in improving the production of a well and/or in maintaining the production equipment. The method and system of the present invention permits injection of the fluid in an optimal amount for facilitating extraction of the crude oil from the well.

Within the existing state of the art, fluids are injected into production wells in a number of different ways. For example, as shown in FIG. 1, fluids for diluting oil being extracted have been injected through the annular space that exists between the well casing and the production tube. The diluting fluid and the crude oil are permitted to mix in an area below the inlet of the pump. This procedure has been found to be unsatisfactory because the injection pressure of the diluting fluid, together with the hydrostatic column of fluid in the annular space, interfere with the production pressure of the oil deposit and reduce the efficiency of the production equipment.

It is also known in the art, as shown in FIG. 2, to inject a fluid into a well through the production pipe. In this arrangement, mixing of the crude and the fluid usually occurs within a perforated nipple located some fifty feet above the production pump. The fluid/oil mixture is permitted to flow to the surface via perforations in the nipple and the annular space between the well casing and the production pipe. There are several disadvantages associated with this technique. First, if a diluting fluid is injected into the well in this way, it does not pass through the production pump. As a result, the high viscosity of the crude oil can cause deterioration of the pump components and ultimate failure of the pump. Second, this arrangement could not be used to inject a maintenance fluid such as an anticorrosive fluid or an oxide inhibitor into the production equipment because again it would not pass through the production pump. Another disadvantage of these techniques is their inability to deliver an assisting fluid in the precise optimal proportions needed to facilitate the extraction process.

SUMMARY OF THE INVENTION

The present invention overcomes these prior art problems by introducing a precise proportion of an assisting and/or maintenance fluid into the production pump without adversely affecting the production equipment. Even more importantly, the fluid is introduced into the production pump without generating a load pressure opposed to the production pressure of the deposit.

The oil recovery system in accordance with the present invention includes means for introducing a precisely proportioned quantity of an assisting treatment or maintenance fluid to the production pump substantially at the level of the oil inlet. The production pump includes a movable piston, means for reciprocally moving the piston, a fixed inlet valve and a traveling outlet valve. The introducing means comprises an opening in the pump casing through which the fluid enters the pump, means for communicating with a supply of the fluid, and a check valve for admitting a precise quantity of fluid. In a preferred embodiment, the supply of fluid comprises a column of fluid in the annular space between the well casing and the production pipe.

In operation, a column of fluid is injected into the annular space between the well casing and the production pipe. During a first phase when the piston is raised, the pump inlet valve opens and crude oil flows into the pump. Simultaneously, the check valve in the fluid introduction means opens and fluid in a predetermined quantity enters the pump through the opening in the casing. During this phase, the oil and fluid become thoroughly mixed. As the piston begins to descend, the inlet valve and the check valve close and the compression phase begins. When the pressure of the oil/fluid mixture becomes greater than the pressure above the piston, the pump outlet valve opens and the oil fluid mixture flows out of the pump. The process repeats itself when the piston begins to rise.

The present invention may be used to introduce a diluting fluid into the pump to reduce the viscosity of the oil being extracted. It may also be used to introduce a treatment or maintenance fluid into the pump to improve production efficiency.

Accordingly, it is an object of the present invention to provide a system and method for improving the recovery of crude oil.

It is a further object of the present invention to provide a system and method as above which is capable of delivering precise quantities of an assisting fluid to oil production equipment without generating a load pressure opposed to the production pressure of the oil.

It is still a further object of the present invention to provide a system and a method as above which can be used to deliver treatment and/or maintenance fluids to the production equipment.

These and further objects and advantages will become more apparent from the following description and drawings in which like reference numerals depict like elements.

DETAILED DESCRIPTION

Figure 3:
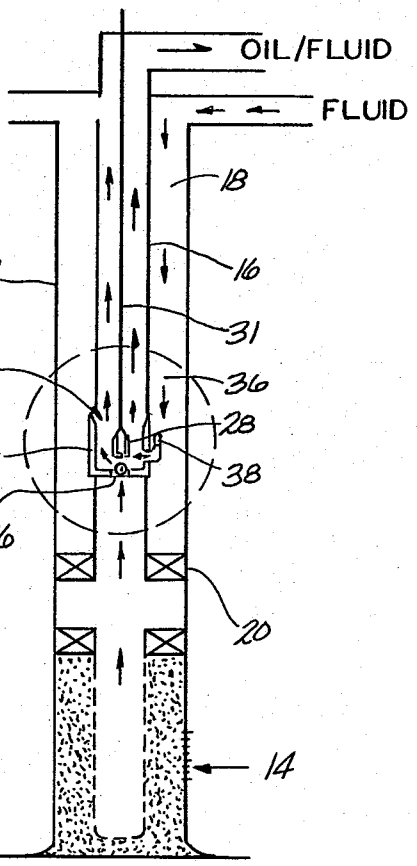
FIG. 3 is a view in partial cross section of an oil recovery system in accordance with the present invention.
Figure 2:
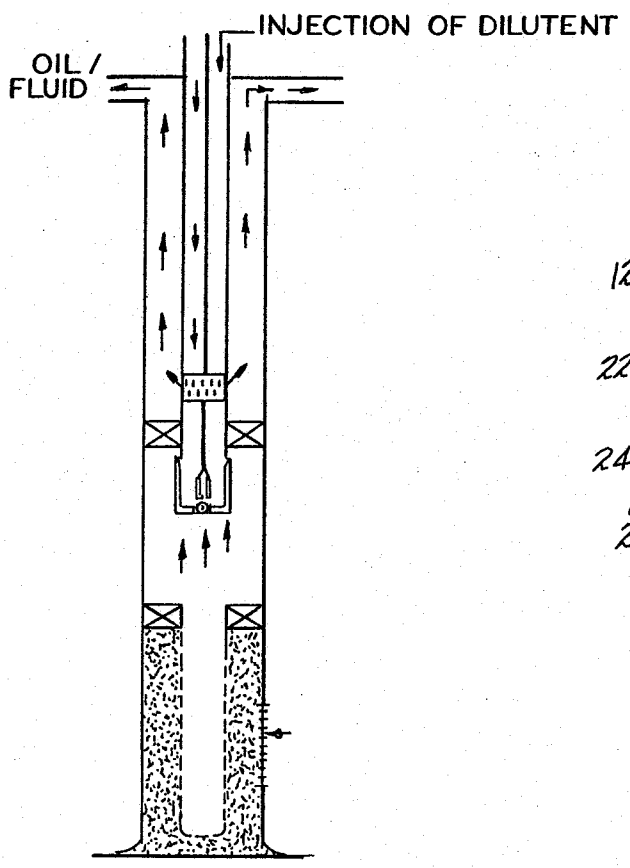
PRIOR ART FIG-2
FIG. 2 is another prior art system for adding fluid to oil.
Figure 1:
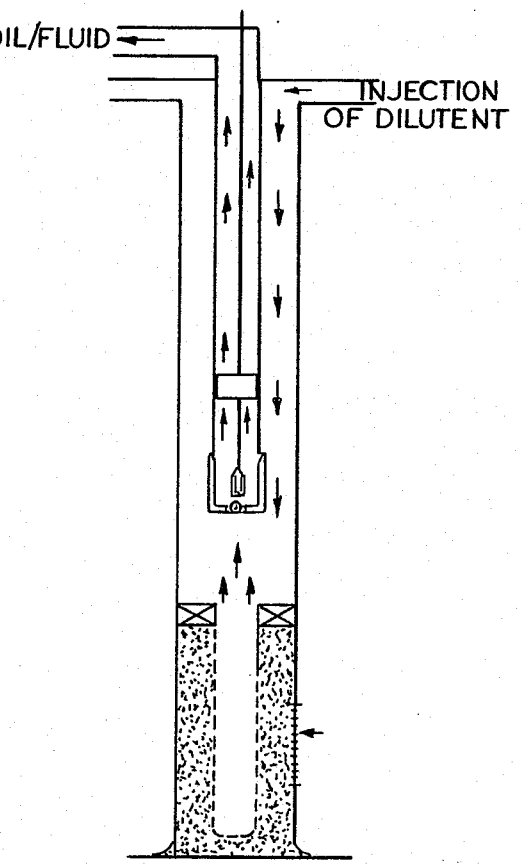
PRIOR ART FIG-1
FIG. 1 is a prior art system for adding fluid to oil.

As previously discussed, the present invention relates to an improved system for recovering crude oil. FIG. 3 illustrates a well opening in the neighborhood of a deposit of crude oil. The well includes a conventional well casing 12 with a series of perforations 14 through which oil flows into the well. A production tube 16 is located centrally within the well casing and defines an annular space 18 with the casing 12. The bottom of the annular space is sealed from the bottom of the formation by a suitable packing material 20.

Figure 5:
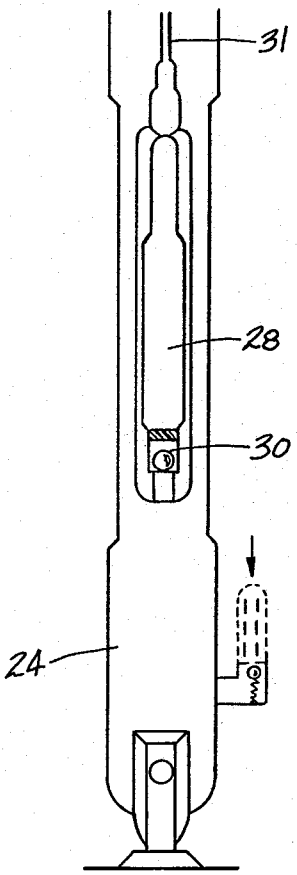
FIG. 5 illustrates a production pump which can be used in the system of the present invention.

A subsoil pump 22 is disposed within the production tube 16 to pump oil from the formation to the surface. The pump 22 as shown in FIG. 5 includes a casing or jacket 24, an inlet 26 such as a fixed inlet valve, a movable piston 28 and an outlet 30 such as a traveling outlet valve. The piston 28 is adapted to move reciprocally up and down. A rod string 31 suspends the piston and is connected to suitable means not shown for causing the piston to rise and descend.

So far, a conventional subsoil pump has been described. In such a pump, oil is drawn into the casing 24 through the inlet valve 26 by raising the piston. When the piston begins to descend, the compression phase begins. When the pressure in the oil in the casing is greater than the pressure above the piston, the outlet valve 30 opens and oil flows into the production tube 16 and ultimately to the surface.

The viscosity of crude oil can be very high. In high productivity wells, this can lead to excessive wear of the pump components and eventually failure of the pump. One technique for overcoming this problem is to dilute the oil with a fluid and form an oil/fluid mixture having a lower viscosity. When using this technique, it is important that: (1) the diluting fluid be added in a proper proportion relative to the oil; and (2) the diluting fluid be added in a way which does not generate a load pressure acting in a direction opposed to the production pressure of the deposit and to the direction in which the oil is pumped to the surface.

Figure 4:
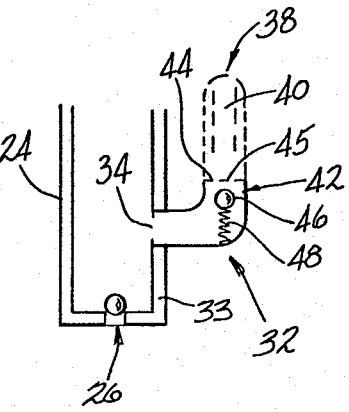
FIG. 4 is an exploded view of the assisting/maintenance fluid introduction arrangement of the present invention.

As shown in FIGS. 3 and 4, the present invention accomplishes these goals by the provision of means 32 for introducing a precisely proportioned quantity of a fluid, such as a dilutant, into the pump 22 substantially at or slightly above the level of the inlet valve 26 and without generating a load pressure acting in a direction opposed to the production pressure of the deposit. The introducing means 32 comprises an opening 34 in a side wall 33 of the pump casing. The opening 34 is preferably sized, i.e. has a predetermined diameter, to deliver a desired quantity of fluid to the pump.

The opening 34 communicates with a supply of fluid 36 in the annular space 18 via a fluid passageway 38. One of the advantages associated with using the annular space 18 to hold the fluid supply is that the weight of the hydrostatic fluid column rests on the packing material 20 which is generally located approximately 30 feet beneath the pump. Any suitable means (not shown) known in the art may be used to inject fluid 36 into the annular space 18.

The inlet of the passageway 38 is preferably formed by a filter 40 which assists in removing contaminants such as particulate matter from the fluid 36. The passageway 38 further includes a check valve 42 for admitting a precise, desired quantity of fluid through the opening 34. The check valve 42 comprises a valve seat 44 having a fluid opening 45, a ball 46 for closing the opening, and a spring 48.

Figure 7:
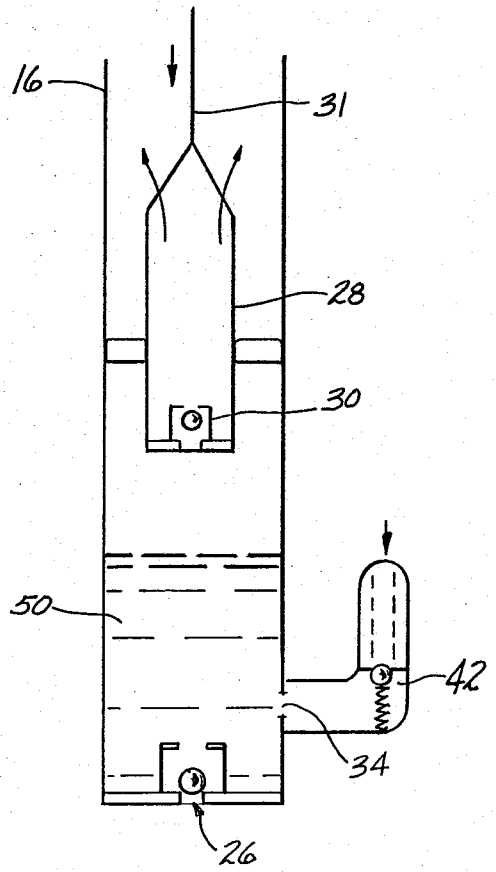
FIG. 7 illustrates a second phase of the method of the present invention.
Figure 6:
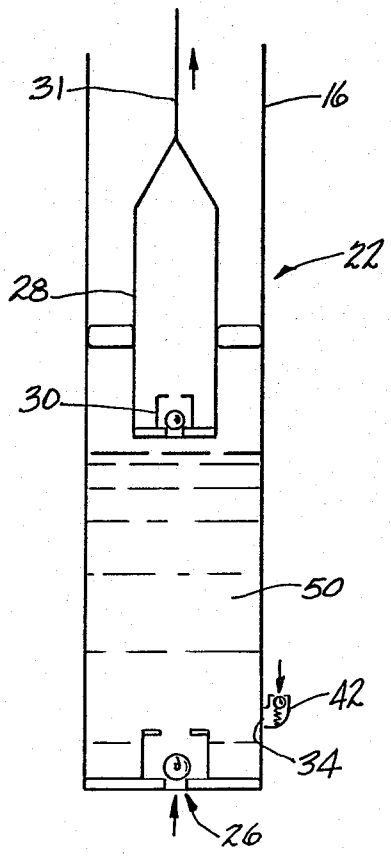
FIG. 6 illustrates a first phase of the method of the present invention.

As shown in FIG. 6, oil and fluid are caused to flow into the pump 22 via the inlet valve 26 and the opening 34 respectively when the piston 28 is raised. The check valve 42 permits only the amount of fluid required to achieve an optimal fluid-crude mixture to pass. It has been found that by simultaneously drawing the oil and fluid into the pump, a thorough mixing of the oil and fluid occurs. As the piston 28 begins to descend, as shown in FIG. 7, the compression phase begins. This causes the ball portion of the inlet valve 26 to seat and close the oil inlet. It also, causes the ball 46 of the check valve 42 to seat, thereby stopping flow of the fluid 36 through opening 34. When the pressure in the oil/fluid mixture 50 becomes greater than the pressure above the piston, the traveling outlet valve 30 opens and the oil/fluid mixture flows into the production tube 16.

As previously mentioned, the fluid 36 may be an assisting fluid such as a dilutant for reducing the viscosity of the crude and facilitating its extraction to the surface or an emulsion separator. The fluid 36 could also be a fluid which helps maintain the equipment such as a corrosion inhibitor or an oxide inhibitor. Still further, the fluid could be a treatment fluid or some other chemical substance such as a skimmer, a flocculator, a parafin inhibitor, or a batericide.

The present invention permits the introduction of an assisting, treatment, or maintenance fluid into an oil pump in a precise amount which can be regulated according to production requirements. If needed, additional regulation of the fluid entering the pump may be provided by making the opening 34 adjustable and/or by adjusting the elements of the check valve. Any suitable means known in the art may be used to make the opening 34 adjustable and/or to adjust the check valve elements. Alternatively, any other suitable proportioning method known in the art may be used to proportion the amount of fluid in the oil.

It is believed that the present invention will greatly facilitate the extraction of crude oil. It should also avoid encountering problems such as flotation of bars, obstruction of valves, loss of diluting fluid and incomplete mixing of crude and fluid.

It is apparent that there has been provided in accordance with this invention a method and system to proportion assisting fluids in a well which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications, and variations as fall within the spirit and broad scope of the appended claims.

What is claimed is:

1. A system for improving the recovery of viscous crude oil from a deep well comprising:

a well casing;

a production tube located within the well casing and defining therewith an annular space having a fluid column therein;

means for pumping oil in a first direction from a subsurface deposit located within said production tube, said pumping means includes a piston mounted within said production tube, an oil inlet below said piston and defining therewith a pumping chamber between the piston and the inlet, an oil outlet above said oil inlet and means for reciprocating said piston within said production tube in a first and second direction so that oil enters through sad inlet when said piston moves in said first direction and exits through said outlet when said piston moves in said second direction;

conduit means for communicating said annular space with said pumping chamber between the piston and the inlet; and metering means located within said conduit means for selectively communicating said annular space with said pumping chamber when said piston moves in said first direction and blocking said conduit means when said piston moves in said second direction.

2. A system according to claim 1 wherein said conduit means is proximate to said inlet.

3. A system according to claim 1 wherein said conduit means includes a filter.

4. A system according to claim 1 further comprising: packing material positioned intermediate said well casing and said production tube at a level below said inlet for supporting said fluid column.

* * * * *